United States Patent [19]

Flemming et al.

[11] Patent Number: 4,942,677

[45] Date of Patent: Jul. 24, 1990

[54] SHOE, ESPECIALLY SPORT SHOE OR SHOE FOR MEDICAL PURPOSES

[75] Inventors: Udo Flemming, Erlangen; Willi Bauer, Herzogenaurach, both of Fed. Rep. of Germany

[73] Assignee: PUMA Aktiengesellschaft Rudolf Dassler Sport, Fed. Rep. of Germany

[21] Appl. No.: 255,484

[22] Filed: Oct. 11, 1988

[30] Foreign Application Priority Data

Oct. 9, 1987 [DE] Fed. Rep. of Germany ..... 3734205

[51] Int. Cl.[5] ..... A43B 13/28; A43B 21/26

[52] U.S. Cl. ..... 36/27; 36/28; 36/35 R

[58] Field of Search ..... 36/35 R, 37, 38, 27, 36/114, 132, 28, 100, 103, 107, 101, 30 R, 81, 82; 128/583, 584, 585, 600, 606

[56] References Cited

U.S. PATENT DOCUMENTS

| | | | |
|---|---|---|---|
| 1,171,879 | 2/1916 | Prenzer | 36/27 |
| 1,637,565 | 8/1927 | Gordon | 36/132 |
| 2,216,630 | 10/1940 | Sabel et al. | 128/584 |
| 2,616,190 | 11/1952 | Darby | 128/585 |
| 2,885,797 | 5/1959 | Chrencik | 36/28 |
| 3,124,887 | 3/1964 | Vassar | 36/81 |
| 3,738,373 | 6/1973 | Glancy | 128/585 |
| 3,984,926 | 10/1976 | Calderon | 36/71 |
| 4,224,747 | 9/1980 | Winfield | 36/11 |
| 4,364,189 | 12/1982 | Bates | 36/31 |
| 4,417,908 | 11/1983 | Metro | 36/38 |
| 4,506,462 | 3/1985 | Cavanagh | 36/92 |
| 4,573,279 | 3/1986 | Feurer-Zogel et al. | 36/35 R |
| 4,598,987 | 7/1986 | Miselich | 36/136 |
| 4,624,061 | 11/1986 | Wezel et al. | 26/114 |
| 4,730,402 | 3/1988 | Norton et al. | 36/30 R |
| 4,798,010 | 1/1989 | Sugiyama | 36/28 |

FOREIGN PATENT DOCUMENTS

| | | | |
|---|---|---|---|
| 2460034 | 6/1976 | Fed. Rep. of Germany . | |
| 2904540 | 8/1980 | Fed. Rep. of Germany . | |
| 3526298 | 1/1987 | Fed. Rep. of Germany | 36/114 |
| 3430845 | 5/1987 | Fed. Rep. of Germany . | |
| 3629340 | 3/1988 | Fed. Rep. of Germany | 36/114 |
| 404686 | 6/1909 | France | 37/37 |

OTHER PUBLICATIONS

*The Running Shoe Book*, by Peter R. Cavanagh 1947, published by Anderson World Inc., Mountain View, Ca.

*Primary Examiner*—Steven N. Meyers

[57] ABSTRACT

In a shoe (1), especially a sport shoe or shoe for medical purposes, with an outsole and a midsole attached to an upper between the outsole and the upper as well as with means for adjusting the height and/or hardness/damping characteristics of the sole, at least in the heel area, via damping inserts that are able to be used interchangeably. This is achieved by the fact that outsole (2) is designed to be separable from the midsole, at least in a portion of the sole extending from the arch area (7) rearward to the heel, and then reattached. A single-part or multiple-part damping insert (14), made of flexible material, can be interchangeably inserted into a space (13) formed between the midsole and the outsole when the outsole (2) is separated.

21 Claims, 3 Drawing Sheets

1
2
3
4
5
6
7
8
9
10
11
12
13
14

FIG. 4
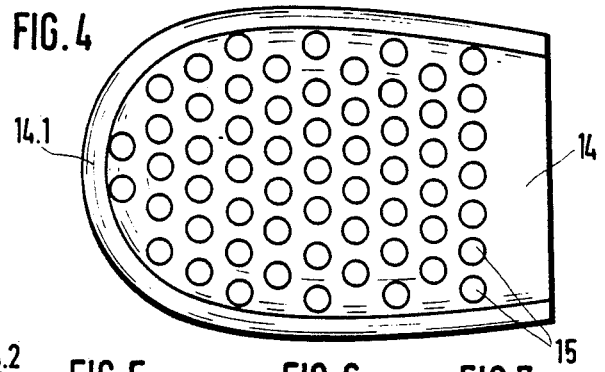
FIG. 5
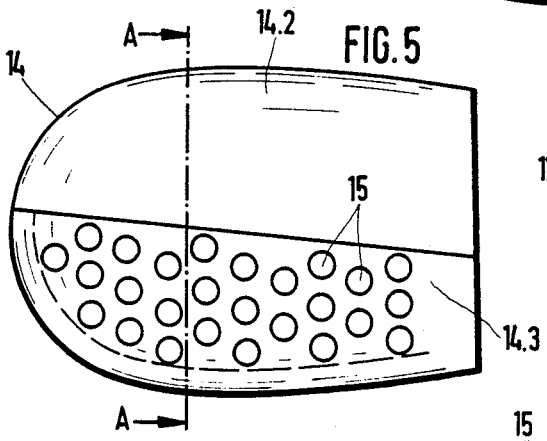
FIG. 6
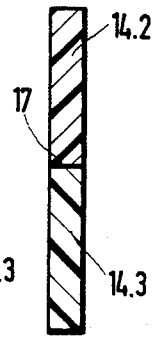
FIG. 7
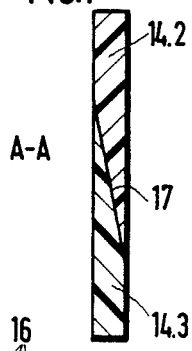
FIG. 8a
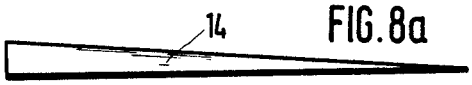
FIG. 8b
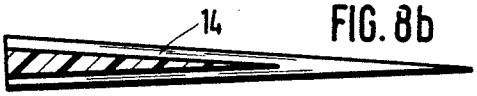
FIG. 8c
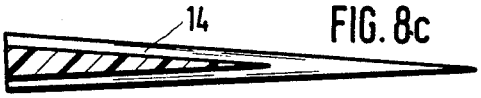
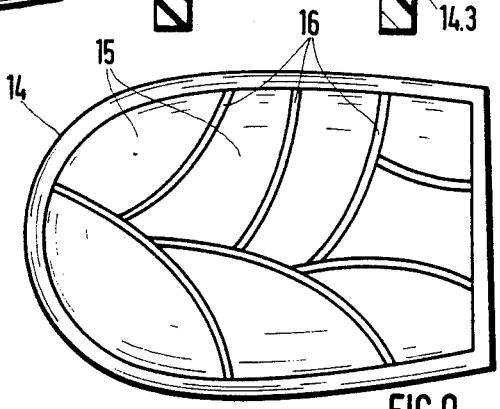
FIG. 9
FIG. 10
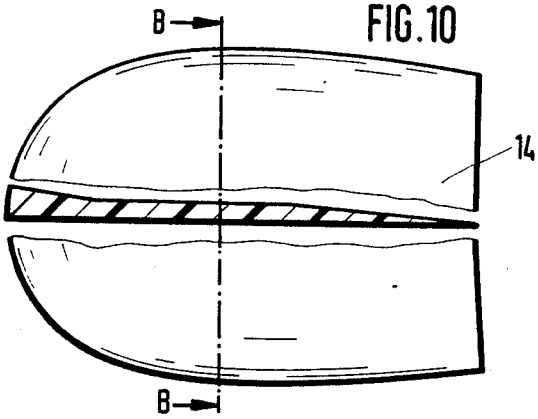
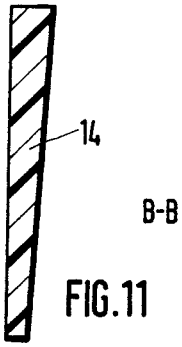
FIG. 11

SHOE, ESPECIALLY SPORT SHOE OR SHOE FOR MEDICAL PURPOSES

BACKGROUND OF THE INVENTION

This invention relates to a shoe, especially a sport shoe or a shoe for medical purposes having a midsole, disposed between an outsole and an upper of the shoe, the hardness/damping and height characteristics of which are adjustable.

A sole for a shoe is known, for example, from German Offenlegungsschrift No. 29 04 540, as well as from U.S. Pat. No. 4,364,189, wherein the heel area is provided with one or more bore holes running crosswise to the longitudinal axis of the shoe. Pin-shaped or tubular damping elements can be inserted interchangeably in them. By different choice of the damping elements the shoe can be correspondingly adapted to the desire of the person wearing it, the selected type of sport or the ground conditions. Such inserts do not vary the height/thickness of the sole.

Further, an outsole for sport shoes is known from German Patent No. 34 30 845, which has at least one recess extending under the heel area in the longitudinal direction of the sole and at least one recess placed crosswise to it. Support bodies are inserted from the outside into the recesses coming together inside the shoe, bodies which meet on the inside being positively connected to one another by shaping. By this means the support bodies can also develop their effect near the heel portion of the sole edge.

SUMMARY OF THE INVENTION

With the present invention, a primary object is to achieve a shoe, especially a sport, shoe or shoe for medical purposes, of the type initially mentioned wherein large-surface (i.e., plate-like as opposed to rod-like) damping parts, optionally also damping parts of different varying thickness, can be used interchangeably.

This object is achieved, in accordance with preferred embodiments, by designing the outsole to be separable from the upper in at least the heel area and by enabling one or more damping elements, serving to modify the height/damping characteristics of the sole, to be interchangeably received within a space formed at an upper side of the outer sole, when the outsole is separated from the midsole/upper, and then retained at the interface between the outsole and midsole upon attachment of the outsole to the midsole/upper.

With the present invention, the damping parts can be adapted to form a separable part of the sole and, therefore, can extend in, each case, over the entire sole surface to its edge. Moreover, the thickness of the damping part or damping parts can be chosen of different height in each or both shoes. The shoe or shoes can thus be adapted to the foot posture of the person wearing the shoe(s). The shoe according to the invention therefore can especially be well used for rehabilitation purposes, for example, in the case of Achilles tendon injuries or operations. Further, the damping part can also exhibit a different form in cross section so that a wrong foot position tilting inward or outward can be equalized, e.g., by an appropriately designed cross-sectional wedge form of the damping part. Also by the use of damping parts of different thickness or of a damping part only in one of the two shoes, a longitudinal equalizing of one of the legs relative to the other is possible.

These and further objects, features and advantages of the present invention will become more obvious from the following description when taken in connection with the accompanying drawings which show, for purposes of illustration only, several embodiments in accordance with the present invention.

BRIEF DESCRIPTION OF THE DRAWINGS

FIG. 1 shows a shoe according to the present invention inside view;

FIG. 2 shows a rear section of the sole of the shoe according to FIG. 1 from the side, partially in section;

FIGS. 3 and 4 are top views of a damping part that can be used according to the invention, in FIG. 3 a center portion having been broken away to show its longitudinal cross section;

FIG. 5 is a top view of a two-part damping part used according to the invention;

FIGS. 6 and 7 are cross sections of two forms of a two-part damping part taken along line A–A of FIG. 5;

FIGS. 8*a*, 8*b* and 8*c* are side views of damping parts with different wedge angles;

FIG. 9 shows a damping part with large-surface hollow spaces;

FIG. 10 is a top view of a wedge-shaped damping part, a center section of which has been broken away and rotated to show its longitudinal cross section;

FIG. 11 shows a cross section of the damping part of FIG. 10 taken along section B—B;

DETAILED DESCRIPTION OF THE PREFERRED EMBODIMENTS

Figures 1, 2, 3:
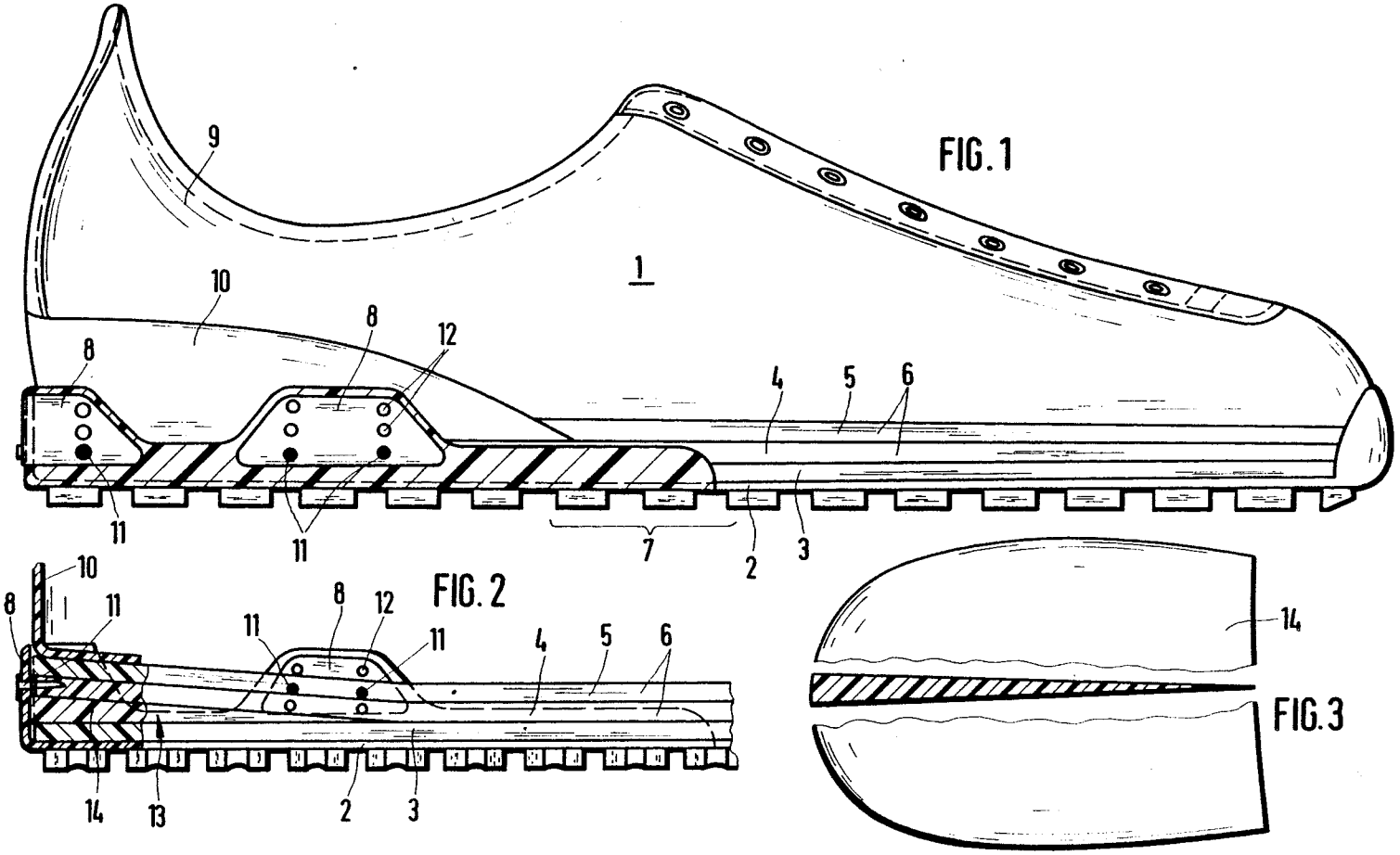

In FIG. 1, a shoe, especially a sport shoe or a shoe for medical purposes, preferably for rehabilitation purposes, is identified by 1. Although a low top (oxford) shoe is represented, this shoe can, of course, be designed as a mid-height (boot) or high top (high boot) style.

Shoe 1 has a sole, which is composed of an outsole 2, optionally with a damping insert 3 solidly fixed to it and a midsole 6 consisting of a first layer 4 and a second layer 5. Midsole 6 can be formed of one, two, or more than two pieces and is conventionally fixed to the upper 9. Outsole 2, damping insert 3 and midsole 6 consist of elastically flexible materials of the type usual and customary for this purpose, namely, the outsole of a wear-resistant material and the midsole of a shock-absorbing material, especially volume-compressible materials.

The sole is designed so that outsole 2, over most of its longitudinal extent, but at least from arch area 7 to the rear end of the shoe, i.e., to the heel, can be separated from midsole 6. Midsole 6 and outsole 2 or its damping insert 3 are, thus, not glued or otherwise solidly or permanently fixed to one another.

Fastening of outsole 2 takes place in the separable section by fasteners 8 attached to it. Fasteners 8 can be connected nonpositively or positively to appropriate counterparts attached to midsole 6 and/or the material of the upper 9 and/or heel cap 10. The detachable connecting parts in each case are designed so that a detachable nonpositive or positive, mechanically reliable connection of the separable part of outsole 2 with the rest of the shoe is guaranteed.

For example, the detachable connection according to FIGS. 1 and 2 takes place by fasteners, designed as upwardly projecting, elastically flexible tabs, whose placement is distributed along the edge of outsole 2. Instead of individual tabs, the entire edge of outsole 2 can project upward in the form of a shell.

In the tabs or the edge of sole 2 are provided one or more rows of at least two holes 12 placed above one another. Securing elements, for example plug-in pins and/or engaging pins 11, that are insertable, buttonable or otherwise engageable with the midsole or the like, are inserted into appropriate holes 12. Pins 11 can be designed like nails, and can be inserted or molded or otherwise formed into or on the midsole. In other words, in the latter case, the pins can be a single component with midsole 6. In FIG. 1, engaging pins 11 are inserted in the lowest holes 12. In this case, outsole 2 here rests with its damping insert 3 directly on midsole 6.

FIG. 2 shows an application, in which engaging pins 11 are inserted into middle holes 12. As a result, a wedge-shaped space 13 is formed between outsole 2 or its damping insert 3 and midsole 6. A damping part 14 (represented in top view and cross section in FIG. 3) which is shaped to the form of space 13, and thus, extends over the total separation surface, can be interchangeably used or inserted to selectively modify the damping and/or height characteristics of the sole.

If engaging pins 11 are inserted into top holes 12 of fasteners 8, space 13 is thus widened and a correspondingly thicker damping part 14 can be used. Three damping parts 14 are represented with different wedge angles in FIGS. 8*a*, 8*b*, 8*c*. In the case of FIG. 8*b*, a damping part 14 of normal height, for example 12 to 14 mm edge height, is shown, while in FIG. 8*a* a damping part with a smaller dimension of, for example, an 8 mm edge height is shown, and FIG. 8*c* shows a damping part with an increased height of, for example, an 18 mm edge height.

It is easy to see that consequently a multiplicity of possibilities for adapting the "heel height" of the shoe and/or of the damping characteristics of the sole in the area of the separable interface between sole 2 and midsole 6 can be achieved. Also damping parts that are not equally high may be used in the two shoes of a pair or a damping part may be used in only one shoe of a pair to equalize different leg lengths.

Damping part 14 and midsole 6, advantageously, are made of an elastic, especially foamed, preferably volume-compressible plastic. In particular, a foamed plastic material with an ethylene-vinyl acetate (EVA) base.

To save weight, but also to achieve a greater softness of damping part 14, the latter can be provided partially or be totally formed with hollow spaces 15, for example, according to FIGS. 4 and 5, with a multiplicity of perforations. Alternatively, according to FIG. 9, a multiplicity of ridges 16 may be formed on damping part 14 to create hollow spaces 15. Hollow spaces 15 can be open on one or both sides or they can be completely closed and be filled with a gas, especially air, optionally with excess pressure.

According to an advantageous configuration of the invention, damping part 14 can be designed in two or more parts. FIG. 4 shows such an embodiment wherein an outside edge piece 14.1 is connected to a remaining central part. Outside edge 14.1, preferably, provides less damping; in other words, has a greater hardness than the remaining part.

In FIG. 5, a two-part longitudinally divided damping part 14 is represented, whose, upper, medial side protector 14.2 is harder than the lower, lateral side perforated part 14.3. Separation plane 17 can run vertically perpendicularly, as shown in FIG. 6, or it can also run obliquely, as represented in FIG. 7. Due to the progressively changing vertical overlap the FIG. 7 arrangement makes possible a more gentle transition from one damping constant to the other of parts 14.2 and 14.3.

According to an advantageous configuration of the invention, damping part 14 can have a transverse (i.e., along line B—B of FIG. 10) wedge shape or trapezoid form in cross section (FIG. 11). By this means a correction of the foot position can be achieved, especially in an abnormal position of the feet or after injury or after operations on the foot or leg.

Damping part 14 can also exhibit other advantageous cross sections. For example, it can be shaped to the anatomy of the foot, as indicated by the cross-sectional portion of FIG. 10.

Many types of connecting elements can be used as fasteners 8 and securing elements 11. For example, auxiliary fasteners, such as, for example, pins or bolts, can be inserted in or screwed through the holes 12 present in the edge or tabs of outsole 2, into midsole 6.

Figure 12:
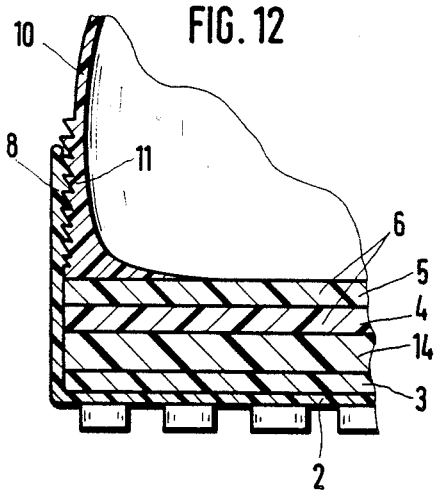
FIG. 12 is a transverse cross-sectional view of a section of a shoe with fasteners for the outsole in the form of interengaging teech.

Instead of the use of holes 12, on the one hand, and of pins or bolts, on the other hand, teeth that are able to mesh with one another can be provided on tab 8 or on the edge of outsole 2 and on heel cap 10 (FIG. 12). Disengagement takes place by a lateral removal or pulling outward of the tab.

Figure 13:
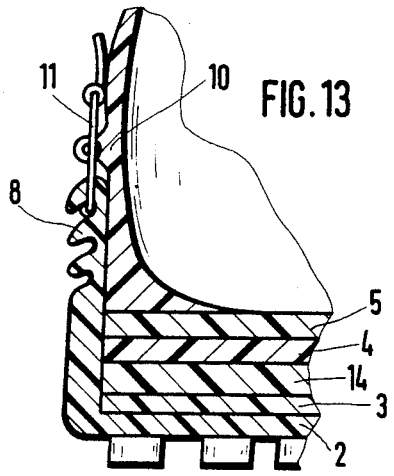
FIG. 13 is a view like FIG. 12 but with fasteners for the outsole in the form of a latch-type snap fastener.

As represented in FIG. 13, a latch-type lever fastener (having a loop-like lever that engages one of hook-like teeth in a similar fashion to ski boot closures) can also be provided as the fastener 8 and securing element 11. The type of connecting elements that can be used is not limited to the embodiments represented and described.

With the invention, a "wedge heel" of varying height and/or damping characteristics can be obtained in numerous different and simple ways. Damping part 14 can, especially, be selected so that the shoe can be adapted to the weight of the person wearing it. Thus, it has proved suitable in the case of a person of a weight of up to 60 Kg to choose a hardness of damping part 14 of about 25 Shore A, up to 70 Kg of about 35 Shore A and up to 80 Kg and more of about 45 Shore A.

While we have shown and described various embodiments in accordance with the present invention, it is understood that the same is not limited thereto, but is susceptible of numerous changes and modifications as known to those skilled in the art, and we, therefore, do not wish to be limited to the details shown and described herein, but intend to cover all such changes and modifications as are encompassed by the score of the appended claims.

We claim:

1. Shoe, especially a sport shoe or shoe for medical purposes, having an upper and a sole formed of an outsole and a midsole disposed between the outsole and the upper as well as an exchangeable adjustment insert means for adjusting at least one of the height and damping characteristics of the sole at least in a heel area thereof, wherein the outsole is separable from the midsole along at least a portion of the length of the sole in an area extending at least from an arch area rearward to a heel end of the shoe, and comprising a detachable fastening means for attaching the outsole to the remainder of the shoe in said area, wherein said adjustment insert means is formed of a flexible material and is selectively inserted in a space formed between the midsole and the outsole when the outsole is separated from the midsole, and wherein said detachable fastening means comprises means for attaching the outsole to the remainder of the shoe with a variably settable spacing therebetween.

2. Shoe according to claim 1, wherein said detachable fastening means comprise fasteners on the outsole and corresponding securing elements for attaching the fasteners on one of the midsole, the upper, and a heel cap on said upper.

3. Shoe according to claim 2, wherein said outsole has an upstanding edge and several rows of at least two holes placed above one another formed therein, and wherein pins are provided for insertion through a hole of each row.

4. Shoe according to claim 2, wherein said fasteners and securing elements are interengageable in one another.

5. Shoe according to claim 2, wherein said detachable fastening means is comprised of tabs formed on the outsole, each tab having at least one row of holes and pins for insertion through a hole of each row.

6. Shoe according to claim 5, wherein said pins are constructed to be inserted or screwed into the midsole

7. Shoe according to claim 6, wherein the thickness of said insert means, at least in said separable area of the sole, tapers in a wedge shape from the heel toward the front end of the shoe.

8. Shoe according to claim 6, wherein said insert means is transversely wedge-shaped.

9. Shoe according to claim 1, wherein the thickness of said insert means, at least in said separable area of the sole, tapers in a wedge shape from the heel toward the front end of the shoe.

10. Shoe according to claim 8, wherein said insert means is transversely wedge-shaped.

11. Shoe according to claim 1, wherein said adjustment insert means has a different damping constant at the medial side of the shoe than at the lateral of the shoe.

12. Shoe according to claims 1, wherein said insert means is provided with hollow spaces over at least a part of its surface.

13. Shoe according to claim 12, wherein said hollow spaces are formed by holes in said insert means.

14. Shoe according to claim 12, wherein said hollow spaces are formed by ridges formed on said insert means.

15. Shoe according to claim 1, wherein said insert means is formed of a foamed ethylene-vinyl acetate material.

16. Shoe according to claim 15, wherein said midsole is formed of a foamed ethylene-vinyl acetate material.

17. Shoe according to claim 1, wherein said insert means has a transverse cross section which changes from a medial side of the shoe to a lateral side of the shoe.

18. Shoe according to claim 17, wherein the cross transverse section of the insert means is one of a wedge shape and a trapezoid shape.

19. Shoe according to claim 1, wherein said insert means is comprised of at least two parts, each of which has at least one of a different damping constant and a different height.

20. Shoe according to claim 1, wherein insert means has a surface shaped to conform with the anatomy of the foot.

21. Shoe according to claim 1, wherein said fastening means comprises a plurality of securing elements on the outsole and a latch-type lever fastener on said remainder of the shoe, said lever fastener being selectively latchable on each of the securing elements to variably set said spacing.

* * * * *